United States Patent [19]

Raimer

[11] 4,014,503

[45] Mar. 29, 1977

[54] METHOD AND APPARATUS FOR CONTROL OF CENTRAL SPACING OF TRACK-OPERATED VEHICLES

[75] Inventor: Juergen Raimer, Linden, Germany

[73] Assignee: Siemens Aktiengesellschaft, Berlin & Munich, Germany

[22] Filed: Mar. 31, 1975

[21] Appl. No.: 563,299

[30] Foreign Application Priority Data

May 17, 1974 Germany ..... 2424161

[52] U.S. Cl. ..... 246/34 R; 246/63 R

[51] Int. Cl.[2] ..... B61L 21/10

[58] Field of Search ..... 246/63 R, 5, 182 B, 246/167 D, 34 R, 34 CT, 122 R, 63 C, 187 B, 187 C, 63 A; 235/150.24; 340/31 R, 38 R

[56] References Cited

UNITED STATES PATENTS

| | | | |
|---|---|---|---|
| 3,268,727 | 8/1966 | Shepard | 246/122 R |
| 3,710,100 | 1/1973 | Perry | 246/63 C |
| 3,748,466 | 7/1973 | Sibley | 246/63 C |
| 3,817,344 | 6/1974 | Asano | 246/122 R |

*Primary Examiner*—Trygve M. Blix
*Assistant Examiner*—Reinhard J. Eisenzopf
*Attorney, Agent, or Firm*—Hill, Gross, Simpson, Van Santen, Steadman, Chiara & Simpson

[57] ABSTRACT

Method and apparatus for central spacing control of track-operated vehicles, particularly railroad vehicles, along paths which are subdivided into individual track sections for the positioning of the vehicles, which sections are continuously monitored as to occupation, in dependence upon the instantaneous position of the vehicles, preferably utilizing stationary information systems, particularly for railroad systems with a dense train succession and track section lengths, and without continuous information channels between vehicles and a main office, in which each of the track sections is continuously monitored in the main office, with respect to occupation thereof by a vehicle or a series of coupled vehicles, to determine whether the path sections ahead of and/or behind the occupied distance, representing a predetermined minimum distance between successive vehicles or series of coupled vehicles, are free of vehicles, and providing an actuating signal, when a section indicated as occupied is within the path range defined by the minimum distance, operative to initiate a forced braking of the following vehicle or vehicles.

7 Claims, 5 Drawing Figures

METHOD AND APPARATUS FOR CONTROL OF CENTRAL SPACING OF TRACK-OPERATED VEHICLES

BACKGROUND OF THE INVENTION

The invention is directed to a method and apparatus for controlling the central spacing of track-operated vehicles, in particular railroad vehicles, along paths which are subdivided into respective individual sections for the positioning of the vehicles, in which occupied sections preferably are continuously so indicated, in dependence upon the instantaneous position of the vehicle or vehicles. Preferably, locally stationary information systems are employed, applicable in particular to railroad systems having dense train traffic and short section lengths, without a continuous information transmission between vehicles and the main office.

It is known from German Letters Pat. No. 1,176,698, in the automatic spacing control of track-operated vehicles, to subdivide the paths traveled by the vehicle into two individual sections and to indicate whether such sections are free or occupied in correspondence to the particular instantaneous position of the vehicle. A main office, operatively associated with a predetermined number of sections, in consideration of the distance between the occupied sections as well as the maximum permissible speeds within the individual sections and the operating and braking properties of the vehicles. From such information a determination may be made with respect to the continued travel of such vehicles. In order to derive this functional succession, a plurality of storage and switching systems are provided in the main office, whereby the dynamic information derived from the vehicles and the static information present in the main office are stored or further processed. The construction of such storage and switching systems must inherently provide a fail-safe operation in accordance with the universal requirements common in railroad control operations, i.e. if a component part becomes defective, dangerous information cannot be supplied to the vehicles. On the contrary, any defect should be made apparent as quickly as possible. In order to achieve these results, not only is it necessary to assure that the circuit means located on the vehicles and in the main office will function in a fail-safe manner, but also to assure a fail-safe reception and transmission between the vehicles and the main office. In railroad systems in which the path is utilized by trains with different operating properties and different speeds, as for example, on long-distance railroad lines, the expense in conjunction with the system, described in the above referred to patent, is justified for achieving the desired vehicle control.

However, where railroad systems involve dense train traffic and short section lengths, as for example, where short-distance traffic systems are involved, the expense required in the patented system would appear to be unjustifiably high, as the vehicles employing such path are usually of corresponding construction and travel at approximately the same speed between individual stations, as a result of which consideration of different vehicle speeds and vehicle characteristics is not required.

Where such a dense train succession, as results in short-distance traffic systems, the path is subdivided into as many short sections as possible in order to obtain an optimum path utilization. Again, in the application of a control system in accordance with the previously referred to patent, this would necessitate that the individual vehicles can be interrogated only at relatively large time intervals within a certain path range, or that, in order to maintain a predetermined call density, the path allocated to a main office must be kept relatively small.

As a result, a control system for short-distance traffic systems and the like should be as simple as possible, and at the same time achieve results generally corresponding to those achieved in the previously mentioned patent, i.e. that successive vehicles do not approach too close to one another but at the same time retaining as simple a construction as the particular short distance traffic system will permit. As a result, vehicles utilizing such a path need not obtain information pertinent to their continued travel, due to the similar physical characteristics and approximately equal operating speeds, nor is it necessary to utilize systems providing a dot or line-shaped information transmission between the vehicles and the main office.

BRIEF SUMMARY OF THE INVENTION

The problem is solved, in accordance with the invention, by the continuous monitoring of each section by a main office, to determine whether a section is occupied by a vehicle or a series of coupled vehicles, and whether the path sections corresponding to the minimum required distance between successive vehicles or coupled vehicles are free of vehicles both ahead of and behind the occupied section. If a section within the path range defined by the minimum distance is occupied, the successive vehicle or vehicles will receive a collision signal causing a forced braking operation.

Such forced braking action can be so defined that the braking action will take place until the vehicle has been braked to a standstill. This can, for example, be achieved by a suitable switching of the driving current in the section occupied by the successive vehicle and possibly in the following sections in the direction of movement.

In accordance with one feature of the invention, storage devices are provided for storing occupation criteria associated with the individual sections, with the outputs of the storage devices for the sections adjacent to the occupied sections being conducted, block by block, to the input of OR members, whereby each section block so formed includes the sections following within a given minimum distance between successive individual or coupled vehicles, with the exception of the section directly adjacent to the occupied section. The output of the OR member associated with the storage systems for the section block positioned, in forward direction, ahead of an occupied section is conducted to an input of an AND member which has its other input connected to the output of the memory system of the occupied section, and the output of such memory system is connected with an input of a further AND member, whose other input is connected with the output of a further OR member having its inputs connected to the memory systems of the adjacent section block in the forward direction of the vehicle, which block is shifted in the forward direction by a number of sections determined by the length of a vehicle or a series of coupled vehicles. Output signals are derived at the outputs of the AND members when the predetermined spacing between successive vehicles or coupled vehicles does not exist, whereby such output signals indicate an inadmissible approach of the vehicle and enables the necessary preventive action to be taken.

The arrangement thus is such that the output signal of the AND member associated with memory systems of a section block disposed in the forward direction, ahead of an occupied section provides a criterion for effecting the vehicle or vehicles in the occupied section while the output signal of the AND member associated with the rear section blocks enables the effecting of a vehicle in one of such section blocks.

BRIEF DESCRIPTION OF THE DRAWINGS

In the drawings wherein like reference characters indicate like or corresponding parts.

DETAILED DESCRIPTION OF THE INVENTION

Figure 1:
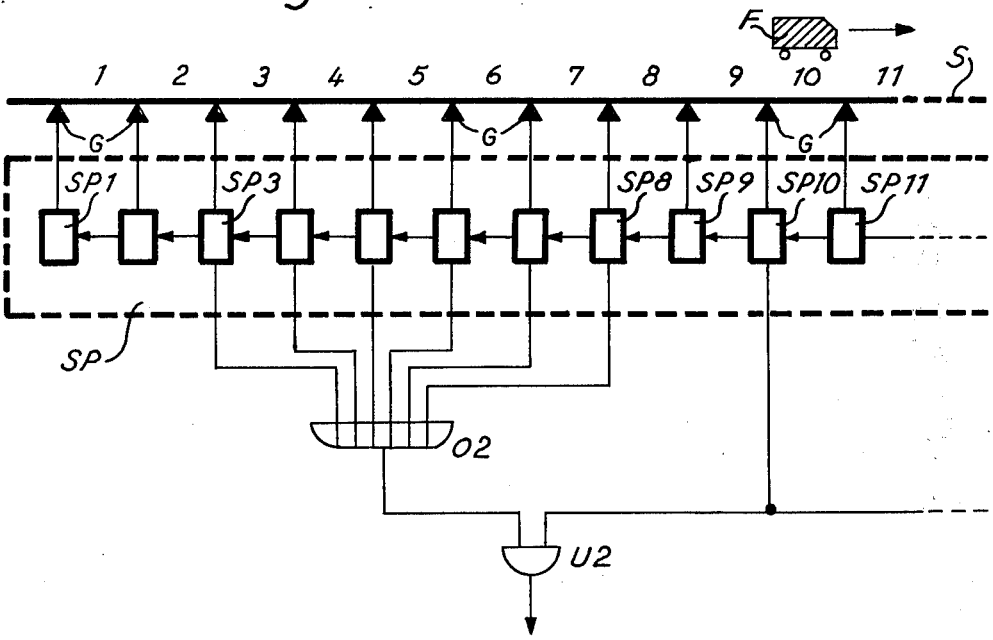
FIGS. 1 and 1*a* schematically illustrate a path occupied by an individual vehicle, as well as central circuit means for controlling a given minimum distance between successive vehicles.
Figure 1A:
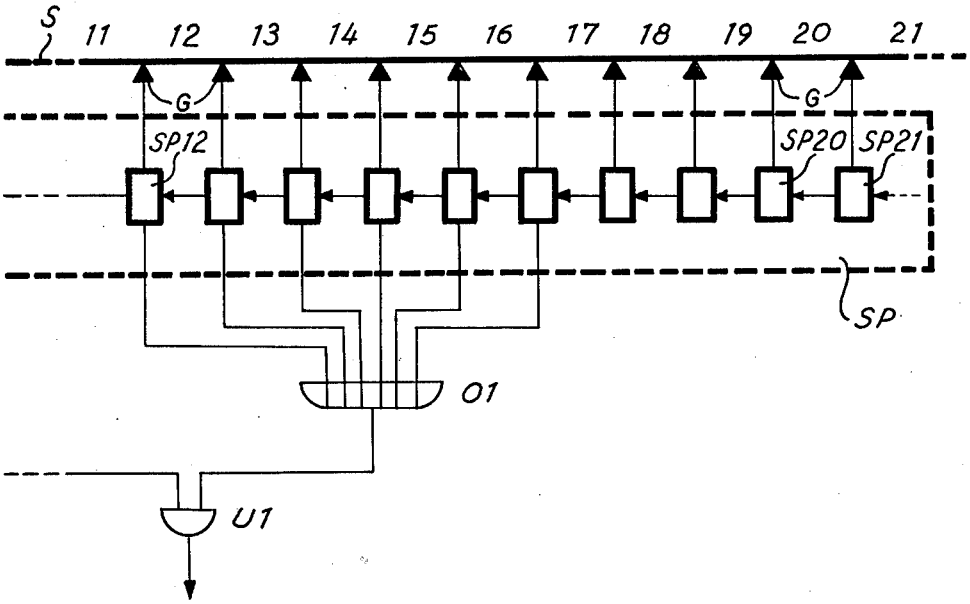

FIGS. 1 and 1*a*, taken together, schematically illustrate a path S which is subdivided into a plurality of adjoining sections 1-21, which sections are of uniform length with respect to one another and are longer than the length of the vehicle or coupled vehicles which are to be used therewith. For illustration, it will be assumed that the path S is utilized in the direction of the arrow i.e. from left to right, and at the instant of observation the section 10 is occupied by a vehicle F.

Location criteria may be derived from respective impulse generators G of any suitable construction, illustrated in the drawing in the form of solid triangles and disposed at the beginning of each of the individual sections. For example, the common types of magnetic, inductive or electronic impulse generators employed in the railroad field or, light barriers of any suitable construction which react to the passage of a vehicle, may be employed. The responsive signals of the impulse generators may be suitably processed in amplifiers and time circuits (not illustrated) from which they are conducted to respective memory circuit means SP where they are stored as an occupied message or signal for criteria of the associated sections of the respective memory systems SP 1 through SP 21. The arrangement is such that, upon the setting of a memory system as a result of occupation of the section, resetting automatically results of the memory system, in the driving direction, which is still indicated as being occupied at that point. In the example illustrated, the memory system SP 10 of the memory SP is thus set and all remaining memory systems SP 1 through SP 9 and SP 11 through SP 21 are in their basic positions.

It will be assumed that in the example illustrated in FIGS. 1 and 1*a*, the shortest permissible minimum distance between successive vehicles is equal to the length of seven sections. In other words, the vehicle F may continue to travel in the desired direction only when the group comprising sections 11 through 17, ahead in the operating direction, are not occupied. In order to determine this condition, the output of the memory systems for the sections which are ahead in the driving direction are conducted to the input of an OR member 01, whereby the section block thus formed includes the successive sections of track up to section 17, with the exception, however, of section 11 which is directly adjacent to the occupied section 10. The output of the OR member 01 is conducted to an input of an AND member U1 whose other input is connected to the output of the memory system SP 10 of the occupied section.

If one of the sections 12 through 17 is occupied, the AND member U1 is unblocked as potential will be present at the output of the OR member 01. The output signal of the AND member U1 effects, by means of suitable circuit means, not illustrated, a collision warning or signal which is operative to initiate a forced braking action on the vehicle F, as such vehicle has too closely approached a preceding vehicle. It will be appreciated that it is immaterial whether the first vehicle has, for example, stalled due to a defect or other interference, or whether the vehicle F has been traveling too rapidly. In either case each successive vehicle, i.e. the vehicle F, will be subjected to a forced braking action. Such forced braking may, for example, be effective to achieve a braking of the vehicle until it is completely stalled which, for example, can be achieved by cutting off the operating current in the associated section.

The section block is shortened by non-inclusion of the section 11, adjacent to the occupied section 10, as the vehicle F upon entry into the section 11 would otherwise result in the transmission of an occupied signal, at least for a short period of time (until the storage system SP 10 is erased), with the simultaneous occupation of section 10 and section 11, thus otherwise causing, over the AND member U1, an initial braking of the vehicle F.

As previously mentioned, a fail-safe construction is a basic requirement in railroad traffic control practice. Such fail-safe construction of all systems included in the vehicle control assures that unavoidable defects or breakdowns are recognized or create a safe condition, i.e. that the vehicles involved are suitably braked. Consequently, it is required that the memories and linkage members in the main office are constructed to effect a safe failure, as well as the subsequently connected circuit means for the production of the collision warning or signal, which results can be readily achieved without difficulties.

If it is desired to construct the impulse generators for the vehicle-location signals in a fail-safe manner, they would have to be at least doubled or direct-current circuits or similar circuit means, operating in accordance with rest-current principles, would have to be employed instead of impulse generators. A corresponding safety to that obtained when employing such circuit means, can be derived when suitable impulse generators are used which do not comply with high demands common in railroad control practice but by means of which it is guaranteed that: (a) an occupied signal which has once been initiated, can in normal operation be erased only after a section, in forward direction, has been indicated as being occupied. (In such manner it is assured that an occupied signal will remain even in a case of interference, for example, if an impulse generator is defective, whereby such occupied signal is not lost or destroyed.) (b) the further passage of a vehicle is dependent upon the control of the path range which is disposed ahead, in the forward direction, by at least two detection processes which are carried out independently of one another, to monitor the unoccupied condition of such path.

The last-mentioned requirement is complied with in accordance with the invention, by the examination for each occupied section not only whether the path section ahead in forward direction is free of preceding vehicles but also whether the group of sections comprising the rear path range is likewise free of successive vehicles. Consequently, in this case, the control circuit means associated with the rear sections occupied by inadmissibly closely advanced vehicles will initiate collision signals independently of one another, which independently will cause a forced braking of the subsequent following vehicle.

Considering the embodiment of FIGS. 1 and 1*a*, if a following vehicle would advance into section 3, the OR member 02, associated with the memory systems SP 3 through SP 8 for the section block positioned behind the occupied section 10 in the direction of travel, will apply a potential to the AND member U2 whereby signal will appear at the output thereof, operative to initiate a forced braking of the following vehicle. Such forced braking action is ultimately effected independently of whether the control switching means involved is associated with section 3, occupied by the following vehicle as a forced braking of the vehicle will take place under control of the section block disposed, in direction of movement, ahead of section 3. This operation will be achieved only when the determination of the occupational state of the controlled path sections can be achieved even in the case of interference, for example in the event of a defective impulse generator. Likewise, this is possible only when the erasure of the occupied signal of a section is made dependent upon the storage of an occupied signal into the storage system of the following section, as is done in the exemplary embodiment.

Assuming, for example, that the impulse generator of section 9 of FIGS. 1 and 1*a* is defective, whereby upon entry of a vehicle F into such section the storage system SP 9 could not be correspondingly set. As long as the memory system SP 9 is not set, the memory system SP 8 for the adjacent section 8, is not reset, whereby the occupied signal at such section remains, independent as to whether or not the vehicle F actuates the memory system SP 10 when it entered section 10. However, assuming that in this case the impulse generator in section 10 operates in proper manner and sets the memory system SP 10 upon occupation of section 10 the signal at the output of the latter will be conducted to an input of the AND member U2 whose other input is connected to the input of the OR member 02. The memory systems of the section block disposed, in forward direction, behind the vehicle F, comprise the sections 3 through 8 and due to the defective impulse generator in section 9, the occupied signal of the vehicle F is still stored in the memory SP 8 so that a potential exists as the output of the OR member 02 which with the signal from the memory system SP 10 will result in an occupied signal with the output of the AND member thus effecting an initial braking of all vehicles entering section 1 after vehicle F. Thus, when the information systems associated with the path become defective, this is reflected in the forced braking of the following vehicle as it approaches the defect.

In the latter case, wherein the occupied signals are initiated in the closely successive sections 8 and 10, it can be readily recognized without difficulty that the occupied signal of section 8, which is rearward with respect to the direction of movement was created by a defect, for example by a defect in the associated impulse generator. An interference signal indicating such a defect may, for example, be achieved by conducting the outputs of the associated memory system SP 8 and SP 10 to an AND member which thus is actuated in the event of simultaneously stored occupied signals and creates a corresponding warning signal. In this manner, a definite interference signal is provided even before a following vehicle enters the defective section block.

It will be appreciated that in the exemplary embodiment of the invention illustrated in FIGS. 1 and 1*a*, only those circuit components (with the exception of the memories SP) have been illustrated which are associated with the assumed occupied section 10 for the illustrated path range. Corresponding circuitry thus must be provided for all remaining sections which are to be connected in a corresponding manner to the outputs of the memory systems. However, it will be apparent that it is possible to utilize the OR members connected to the memory systems for the individual section blocks in a dual manner since the section block associated therwith is in one instance positioned ahead of an occupied section, as viewed in the direction of movement, and once behind a respective occupied section. Thus, in the specific example illustrated, the OR member 02, involving sections 3 through 8, may also be used for controlling the section block positioned ahead of section 1, in the driving direction, and in like manner the OR member 01 also may be utilized for controlling the section block positioned rearwardly of section 19 comprising sections 12 through 17.

Figure 2:
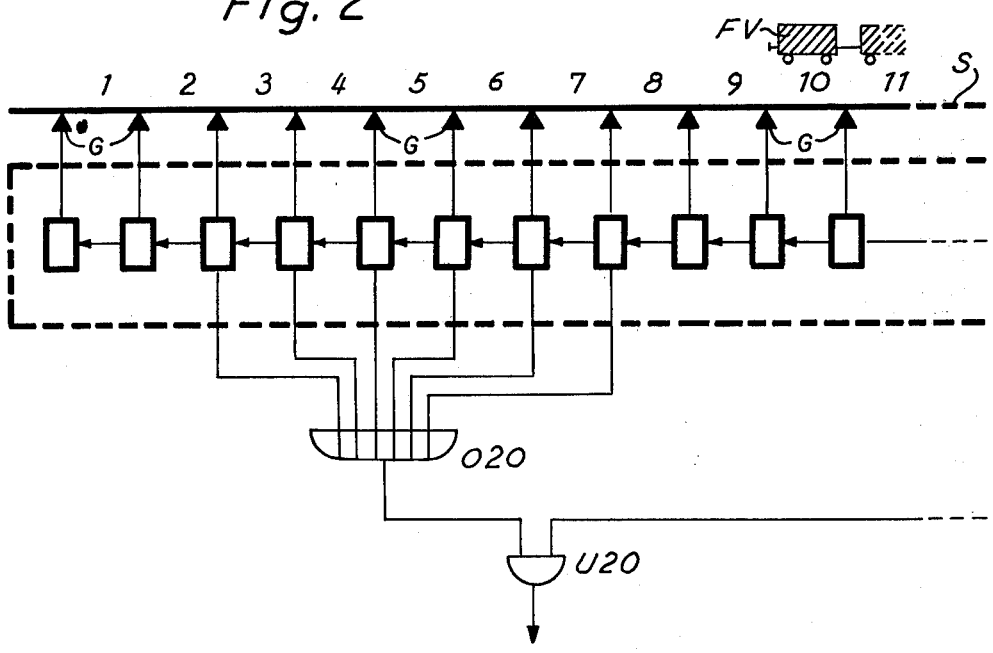
FIGS. 2 and 2*a* illustrate a modification of the embodiment of FIGS. 1 and 1*a*, in which the path involved is utilized by a fairly long series of coupled vehicles.
Figure 2A:
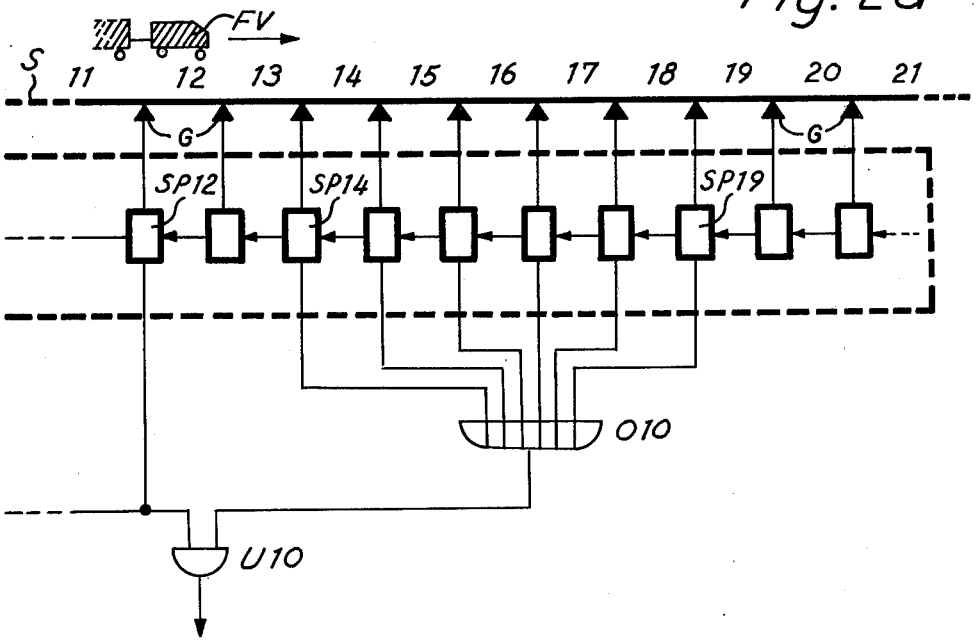

FIGS. 2 and 2*a* illustrate a modification of the exemplary embodiment of FIGS. 1 and 1*a*, in which it is assumed that the path involved is employed by vehicles or series of coupled vehicles whose overall length is greater than the length of an individual section. In the illustrated embodiment, the length of the series of coupled vehicles FV, utilizing the path corresponds approximately to the length of three sections, with the illustrated vehicle FV thus utilizing sections 9 through 12 at the instant illustrated. The control of the section block disposed ahead of sections 10 through 12, as viewed in the forward direction, and thus comprising sections 14 through 19, is effected in the embodiment of FIGS. 2 and 2*a* by an OR member 010 which is connected to the outputs of memory systems SP 14 through SP 19 and which thus controls one of the inputs of the AND member U10, the other input of which is connected to the output of the memory system SP 12 of the occupied section 12. If one of the sections of the section block disposed ahead of the occupied sections 10-12 is indicated as being occupied, or is occupied, the AND member U10 will then display an output potential, causing the forced braking of the coupled vehicles FV.

In like manner, the section block disposed, in the direction of movement, behind the coupled vehicle FV, comprising sections 3 through 8, is controlled by an OR member 020 and a subsequently connected AND member U20. Consequently, if one of sections 3 through 8 is occupied by a following vehicle, a potential will be conducted from the OR member 01 to one of the inputs of the AND member U20, the other input of which is actuated by the output signal of the memory system SP 12. An output potential will thus appear at the output of the AND member U20 thereby causing the initial braking of successive vehicle or coupled vehicle. The section block positioned, in the forward direction, behind the series of coupled vehicles is shifted with respect to the embodiment illustrated in FIG. 1 over a number of sections (two sections) corresponding to the length of the coupled vehicle, since the free distance which must be maintained between successive vehicles or series of coupled vehicles is determined from the leading end of a following vehicle to the trailing end of the previous vehicle or coupled vehicles.

An interruption of a line extending to the main office from one of the impulse generators positioned along the path, will have substantially the same effect as a defective impulse generator, as an occupied signal cannot be stored, resulting in the occupied signal of the preceding section being maintained.

The method of the present invention can even be applied to a situation wherein an entire cable between the impulse generators and the main office is severed, for example due to an accident, by the expedient of disposing the lines extending from the impulse generators of adjacent sections to the main office in different cable strands. Consequently, even if one cable strand is severed, an occupied signal can be initiated and stored at least for each second within a section block when such section is occupied, so that in an emergency a forced braking can still be effected.

Figure 3:
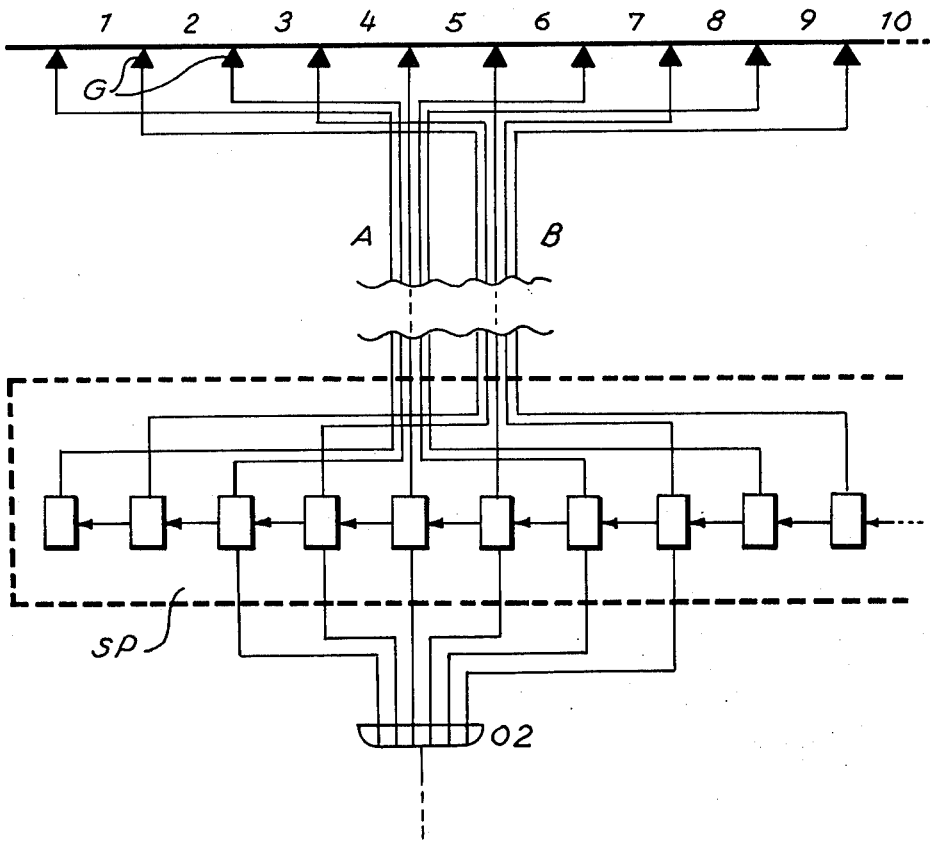
FIG. 3 is a figure similar to FIGS. 1–1*a* and FIGS. 2–2*a* illustrating the use of a plurality of cable strands for the electrical connections of various circuits.

FIG. 3 illustrates a circuit similar to FIG. 1, illustrating the use of two cable strands A and B for effecting the connections between the generators G and the memory circuit means SP with the odd numbered generators being connected to the corresponding memory circuits by the cable strand A and the even numbered generators being connected to their associated memory circuits by cable strand B. Thus, if either one of the cable strands were severed, only every other generator and memory circuit would be rendered inoperative and the system as a whole thus would not be rendered inoperative.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. A method for central spacing control of track-operated vehicles, particularly railroad vehicles, along paths which are subdivided into individual track sections for the positioning of the vehicles, which sections are continuously monitored as to occupation, in dependence upon the instantaneous position of the vehicles, preferably utilizing stationary information systems, particularly for railroad systems with a dense train succession and small track section lengths, and without continuous information systems between vehicles and a main office, comprising the steps of continuously monitoring in the main office, for the track sections indicated as being occupied by a vehicle or a series of coupled vehicles, a group of sections behind and a group of sections ahead thereof, defining a predetermined minimum distance between successive vehicles or series of coupled vehicles, to determine whether such groups of sections ahead of and behind the occupied sections are free of vehicles, and actuating a signal for initiating a forced braking of the following vehicle or vehicles when a section, in either of said groups, is indicated as occupied and thus is within the path range defined by such minimum distance.

2. An arrangement for central spacing control of track-operated vehicles, particularly railroad vehicles, along paths which are subdivided into individual track sections for the positioning of the vehicles, which sections are continuously monitored as to occupation, in dependence upon the instantaneous position of the vehicles, preferably utilizing stationary information systems, particularly for railroad systems with a dense train succession and small track section lengths, and without continuous information systems between vehicles and the main office, comprising the combination of respective means associated with each individual track section for monitoring such section and providing a signal when such section is occupied, a memory system for each section arranged to receive and store occupied signals pertaining thereto, an OR member for predetermined adjacent sections ahead of the occupied section and an OR member for predetermined adjacent sections behind such occupied section, and forming respective preceding or following section blocks, each section block including a predetermined number of track sections operative to define a minimum distance between successive vehicles or coupled vehicles, both preceding and following an occupied section or group of sections, excluding at least one section immediately adjacent to an occupied section, the memory systems of the track sections of each adjacent preceding, and following section block being operatively connected to a respective OR member, and an AND member for each such OR member, having one input connected to the output of the associated OR member and another input connected to the output of the occupied track section or of one of a group of occupied track sections, each AND member being operable in the presence of an occupied signal at both of its inputs to provide an output signal indicating unpermissible close approach of a following vehicle with respect to a preceding vehicle.

3. A system according to claim 2, wherein said monitoring means comprises impulse generators, actuatable by the vehicles, disposed along the path and operative to set the associated memory systems of the respective sections when a vehicle passes by, the setting of a memory system being operative to effect a resetting of the memory of the preceding section.

4. A system according to claim 3, wherein the respective electrical connecting lines from the impulse generators of adjacent sections extending to the main office are located in different cable strands.

5. A system according to claim 2, wherein the output signal of the AND member associated with the section block ahead of an occupied section is operatively connected to means affecting the vehicle or vehicles in the occupied section, while the output signal of the AND member associated with the section block behind the occupied section is operatively connected to means affecting vehicles positioned within such rear section block.

6. A system according to claim 2, comprising in further combination, means for monitoring selected memory systems to determine the presence of occupied signals stored therein, operative to provide an interference signal in the presence of simultaneously stored occupied signals in such selected memories, said selected memory systems being attached to sections in a distance equal to the length of the vehicle or vehicles occupying the first of both respective sections.

7. A system according to claim 6, wherein said last-mentioned monitoring means comprises an AND member, the inputs of which are operatively connected to the respective selected memories, with such interference signal being derived at the output of such end member.

* * * * *